US005333664A

United States Patent [19]

Sirianni et al.

[11] Patent Number: 5,333,664

[45] Date of Patent: Aug. 2, 1994

[54] SHOWER DOOR PROTECTOR SHADE

[76] Inventors: Richard Sirianni, 90 San Juan Ave.; Thomas Minutillo, 140 Wentworth Ave., both of Albertson, N.Y. 11507; John Yaworski, 59 Peninsula Blvd., Valley Stream, N.Y. 11581; Robert Maurer, 30 Forset Ave., Valley Stream, N.Y. 11580

[21] Appl. No.: 61,554

[22] Filed: May 17, 1993

[51] Int. Cl.[5] ..... E06B 9/08

[52] U.S. Cl. ..... 160/23.1; 160/903; 4/558

[58] Field of Search ..... 160/23.1, 24, 903; 4/610, 558, 608; 248/266

[56] References Cited

U.S. PATENT DOCUMENTS

| | | | |
|---|---|---|---|
| 2,354,832 | 8/1944 | Ristine | 160/23.1 X |
| 2,481,397 | 9/1949 | Dalton, Jr. | 4/558 |
| 2,580,103 | 12/1951 | Keller et al. | 160/23.1 X |
| 2,756,438 | 7/1956 | Soberman | 4/608 |
| 2,840,827 | 7/1958 | Calvano | 160/23.1 X |
| 3,222,689 | 12/1965 | Efron et al. | 4/608 |
| 3,719,220 | 3/1973 | Small | 160/23.1 X |
| 4,122,559 | 10/1978 | Kelly | 4/608 |
| 4,282,919 | 8/1981 | Teno | 160/23.1 |
| 5,033,132 | 7/1991 | Greenblatt | 160/23.1 |

FOREIGN PATENT DOCUMENTS

| | | | |
|---|---|---|---|
| 6413974 | 6/1965 | Netherlands | 4/608 |

*Primary Examiner*—Blair M. Johnson
*Attorney, Agent, or Firm*—Michael I. Kroll

[57] ABSTRACT

A protector shade is provided for a sliding glass door assembly having a frame with a top rail and two sliding glass doors for a bathtub which consists of an elongate housing, with a structure for attaching the elongate housing behind the top rail of the frame of the sliding glass door assembly. An elongate shade roller is rotatably mounted within the elongate housing, so that when the elongate shade roller is pulled down, it will keep slime, soap and dirty water off the two sliding glass doors.

15 Claims, 2 Drawing Sheets

SHOWER DOOR PROTECTOR SHADE

BACKGROUND OF THE INVENTION

1. Field of the Invention

The instant invention relates generally to sliding glass doors for showers and bathtubs and more specifically it relates to a shower door protector shade.

2. Description of the Prior Art

Numerous sliding glass doors have been provided in prior art that are adapted to enclose bathtubs, showers and smaller shower stalls, to prevent the leakage of water therefrom. Fungus and other grime can build up within the tracks to interfere with the operation of the sliding glass doors. While these units may be suitable for the particular purpose to which they address, they would not be as suitable for the purposes of the present invention as heretofore described.

SUMMARY OF THE INVENTION

A primary object of the present invention is to provide a shower door protector shade that will overcome the shortcomings of the prior art devices.

Another object is to provide a shower door protector shade which clips on and off a top rail, so that it will cover the inside of the existing shower or bathtub sliding glass door assembly, to keep slime, soap and dirty water off and out of the tracks.

An additional object is to provide a shower door protector shade which contains squeegees that will scrape the water off the shade, so that when the shade is rolled up it will store dry.

A further object is to provide a shower door protector shade that is simple and easy to use.

A still further object is to provide a shower door protector shade that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
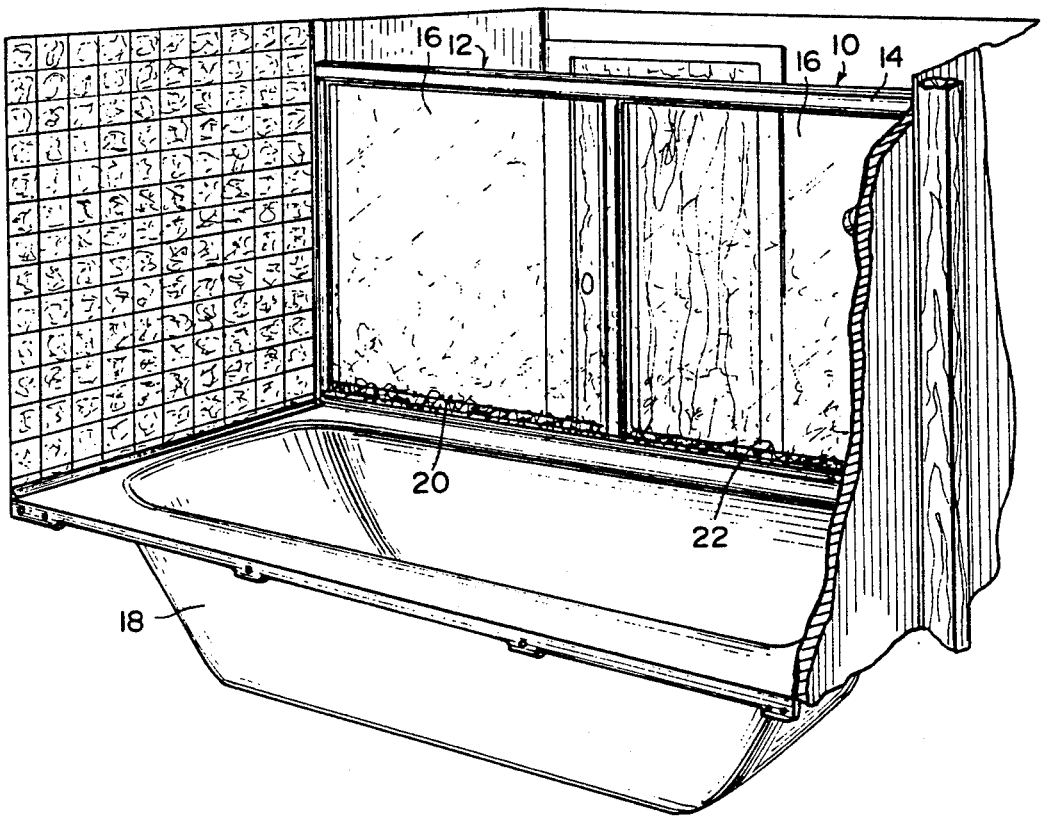
Fig. 1 (PRIOR ART)
FIG. 1 is a perspective view with parts broken away of the prior art, in which the sliding glass door assembly of the bathtub is not protected.

Turning now descriptively to the drawings, in which similar reference characters denote similar elements throughout the several views, FIG. 1 illustrates the prior art which consists of a sliding glass door assembly 10, having a frame 12 with a top rail 14 and two sliding glass doors 16 for a bathtub 18. Fungus 20 and other grime can build up within the tracks 22, to interfere with the operation of the sliding glass doors 16.

Figure 2:
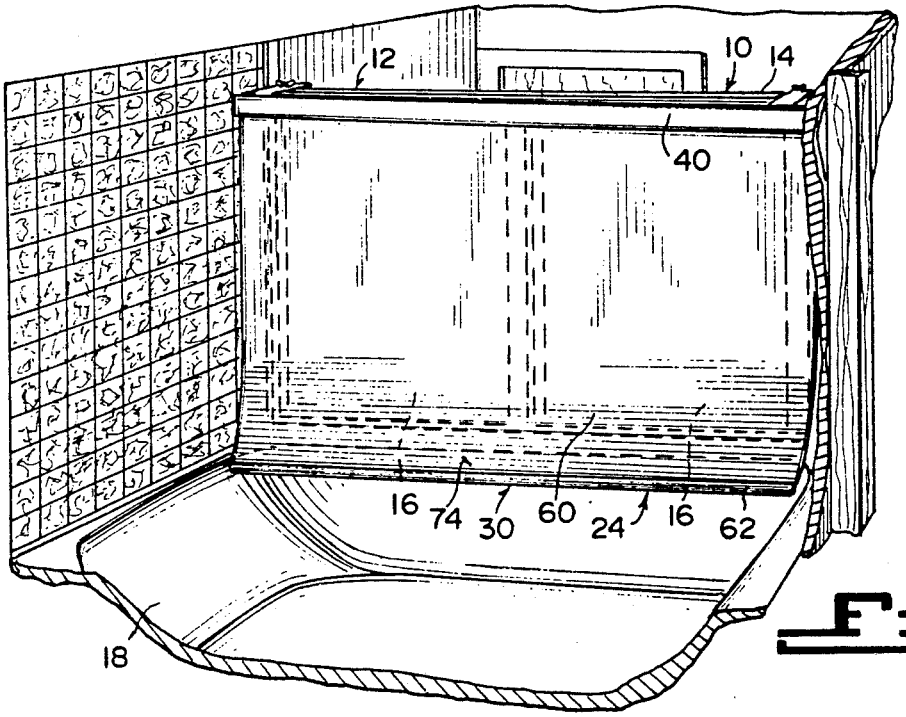
FIG. 2 is a perspective view with parts broken away showing the instant invention installed thereon and in use, to protect the sliding glass door assembly of the bathtub.

The instant invention shown in FIGS. 2 through 5 is a protector shade 24 for the sliding glass door assembly 10, which consists of an elongate housing 26. A structure 28 is for attaching the elongate housing 26 behind the top rail 14 of the frame 12 of the sliding glass door assembly 10. An elongate shade roller 30 is rotatably mounted within the elongate housing 26, so that when the elongate shade roller 30 is pulled down, as shown in FIG. 2, it will keep slime, soap and dirty water off the two sliding glass doors 16.

The elongate housing 26 includes a rear wall 32, a bottom wall 34 connected to an extending from the rear wall 32 and a pair of side walls 36. Each side wall 36 has a central hole 38 and is connected to and extending from the rear wall 32 and the bottom wall 34, so that the elongate shade roller 30 can fit therein to be rotatably mounted.

The protector shade 24 further contains an elongate L-shaped lid 40 and a hinge 42 between the rear wall 32 and the elongate L-shaped lid 40. When the elongate L-shaped lid 40 is closed it will cover the top and front of said elongate housing 26, to enclose the elongate shade roller 30 therein.

The attaching structure 28 includes a pair of adjustable brackets 44, spaced apart and connected to the elongate L-shaped lid 40. The adjustable brackets 44 can clip onto the top rail 14 of the frame 12. Each adjustable bracket consists of a long flat leg 46 having a longitudinal slot 48 therein. A short flat leg 50 extends downwardly from the long flat leg 46. A fastener 52 extends through the longitudinal slot 48 in the long flat leg 46 and into the elongate L-shaped lid 40, so that the long flat leg 46 can be adjustable thereto, allowing the short flat leg 50 to grip the top rail 14 of the free 12. The fastener 52 is a wing head bolt 54, so that the bolt 54 can be manually operated by hand.

The elongate shade roller 30 includes a cylindrical roller 56 with a pair of pins. Each pin 58 extends from one end of the cylindrical roller 56 to rotate within one central hole 38 in one side wall 36 of the elongate housing 26. A shade body 60 is attached at an upper end to the cylindrical roller 56. The shade body 60 can wrap about the cylindrical roller 56 and when pulled down will protect the two sliding glass doors 16, while also acting as a modesty shade.

A hem 62 is formed on a lower edge of the shade body 60. A slat 64 is carried within the hem 62, to give stability to the shade body 60, while providing a place to grip when pulling down and raising up the shade body 60.

A pair of squeegees 66 are provided, wherein one squeegee 66 is located along a free edge of the bottom wall 34 of the elongate housing 26, while the other squeegee 66 is located along a free edge of the elongate L-shaped lid 40. When the elongate housing 26 is attached behind the top rail 14 of the frame 12 of the sliding glass door assembly 10 and the elongate L-shaped lid 40 is closed, the pair of squeegees 66 will scrape water off of the shade body 60. When the shade body 60 is rolled up on the cylindrical roller 56, it will store dry within the elongate housing 26. Each squeegee 66 includes an elongate rubber blade 68, to extend across a full width of the shade body 60, so as to remove the water therefrom.

Figures 3, 4, 5:
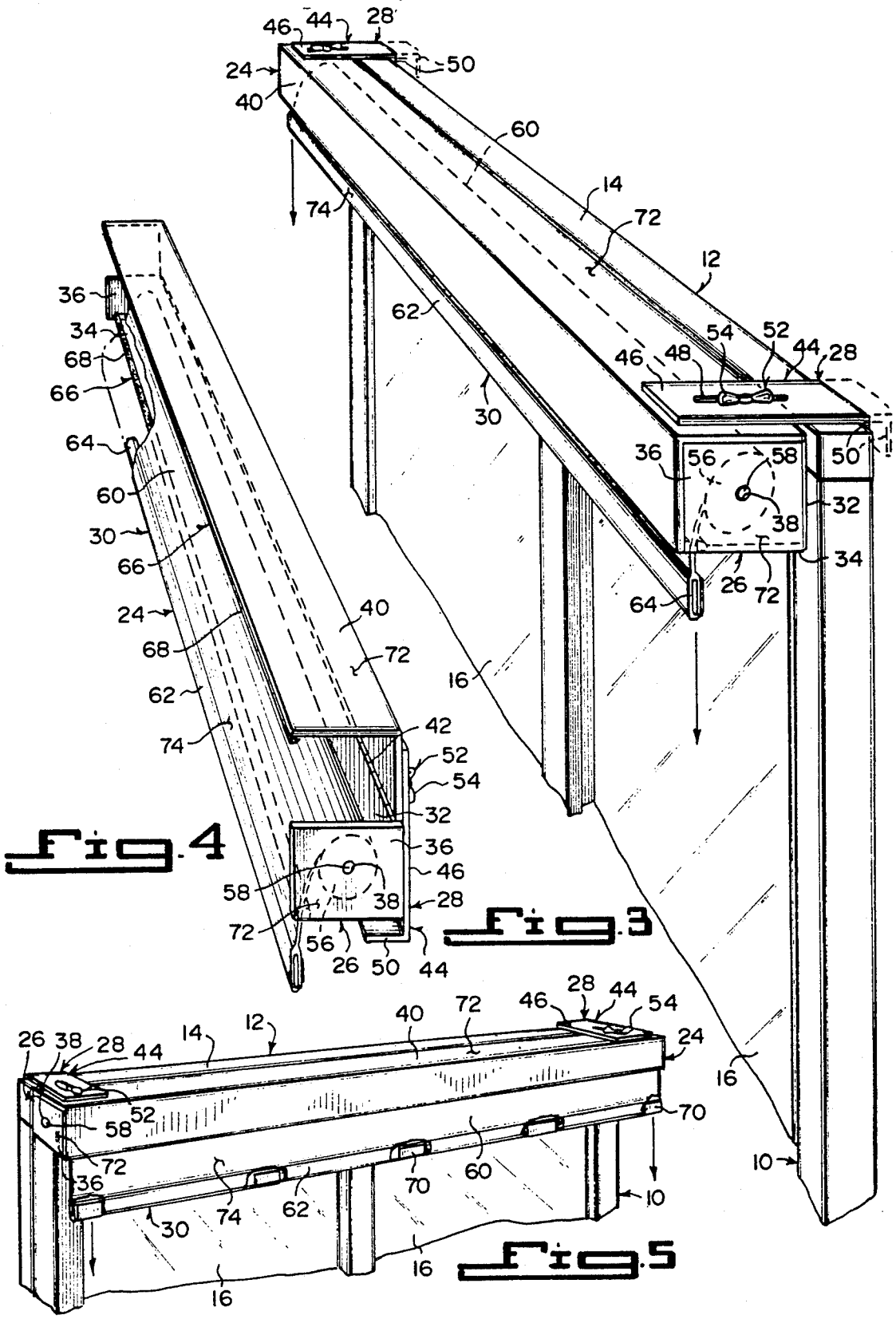
FIG. 3 is a perspective view of an upper portion of the sliding glass door assembly and the instant invention installed thereon, with the shade body ready to be pulled down.
FIG. 4 is a perspective view of the instant invention per se with parts broken away and the cover open.
FIG. 5 is a perspective view of the upper portion of the sliding glass door assembly, showing a modification in which magnetic tabs are placed on the hem to engage with the steel bathtub.

A plurality of magnetic tabs 70, as shown in FIG. 5, are affixed to an inner side of the hem 62 on the lower edge of the shade body 60. When the shade body 60 is pulled down, the magnetic tabs 70 can stick to the bathtub 18 if made out of magnetic material.

The rear wall 32, the bottom wall 34 and the side walls 36 of the elongate housing 26 are fabricated out of a durable non-corrosive material 72. The elongate L-shaped lid 40 and the hinge 42 are fabricated out of the durable non-corrosive material 72. The long flat leg 46, the short flat leg 50 and the fastener 52 of each adjustable bracket 44 are fabricated out of the durable non-corrosive material 72. The cylindrical roller 56, the pins 58 and the slat 64 of the elongate shade roller 30 are fabricated out of the durable non-corrosive material 72. The durable non-corrosive material 72 is stainless steel. The shade body 60 is fabricated out of a thin durable flexible waterproof material 72, which is plastic.

LIST OF REFERENCE NUMBERS

10 sliding glass door assembly
12 frame
14 top rail of 12
16 sliding glass door
18 bathtub
20 fungus
22 track in 12
24 protector shade
26 elongate housing
28 attaching structure
30 elongate shade roller
32 rear wall of 26
34 bottom wall of 26
36 side wall of 26
38 central hole in 36
40 elongate L-shaped lid
42 hinge
44 adjustable bracket
46 long flat leg of 44
48 longitudinal slot in 46
50 short flat leg of 44
52 fastener
54 wing head bolt
56 cylindrical roller
58 pin in 56
60 shade body
62 hem on 60
64 slat in 62
66 squeegee
68 elongate rubber blade
70 magnetic tab
72 durable non-corrosive material
74 thin durable flexible waterproof material It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A protector shade for a sliding glass door assembly having a frame with a top rail and two sliding glass doors for a bathtub which comprises:

a) an elongate housing;
b) means for attaching said elongate housing behind the top rail of the frame of the sliding glass door assembly;
c) an elongate shade roller rotatably mounted within said elongate housing; said housing comprising:
d) a rear wall;
e) a bottom wall connected to and extending from said rear wall;
f) a pair of side walls, each having a central hole and connected to and extending from said rear wall and said bottom wall;
g) an elongate L-shaped lid; and
h) a hinge between said rear wall and said elongate L-shaped lid, whereby when said elongate shade roller is pulled down it will keep slime, soap and dirty water off the two sliding glass doors, said elongate shade roller can fit in said central holes of said side walls to be rotatably mounted, and when said elongate L-shaped lid is closed it will cover the top and front of said elongate housing, to enclose said elongate shade roller therein.
i) wherein said attaching means includes al pair of adjustable brackets, spaced apart and connected to said elongate L-shaped lid, so that said adjustable brackets can clip onto the top rail of the frame.

2. A protector shade for a sliding glass door assembly as recited in claim 1, wherein each said adjustable bracket includes:

a) a long flat leg having a longitudinal slot therein;
b) a short flat leg extending downwardly from said long flat leg; and
c) a fastener to extend through said longitudinal slot in said long flat leg and into said elongate L-shaped lid, so that said long flat leg can be adjustable thereto, allowing said short flat leg to grip the top rail of the frame.

3. A protector shade for a sliding glass door assembly as recited in claim 2, wherein said fastener is a wing head bolt, so that said bolt can be manually operated by hand.

4. A protector shade for a sliding glass door assembly as recited in claim 3, wherein said elongate shade roller includes:

a) a cylindrical roller;
b) a pair of pins, each extending from one end of said cylindrical roller to rotate within one central hole in one said side wall of said elongate housing; and
c) a shade body attached at an upper end to said cylindrical roller, so that said shade body can wrap about said cylindrical roller and when pulled down will protect the two sliding glass doors, while also acting as a modesty shade.

5. A protector shade for a sliding glass door assembly as recited in claim 4, wherein said elongate shade roller further includes:

a) a hem formed on a lower edge of said shade body; and b) a slat carried within said hem to give stability to said shade body, while providing a place to grip when pulling down and raising up said shade body.

6. A protector shade for a sliding glass door assembly as recited in claim 5, further including a pair of squeegees, wherein one said squeegee is located along a free edge of said bottom wall of said elongate housing, while other said squeegee is located along a free edge of said elongate L-shaped lid, so that when said elongate housing is attached behind the top rail of the frame of the sliding glass door assembly and said elongate L-shaped lid is closed, said pair of squeegees will scrape water off of said shade body, whereby when said shade body is rolled up on said cylindrical roller it will store dry within said elongate housing.

7. A protector shade for a sliding glass door assembly as recited in claim 6, wherein each squeegee includes an elongate rubber blade to extend across a full width of said shade body, so as to remove the water therefrom.

8. A protector shade for a sliding glass door assembly as recited in claim 7, further including a plurality of magnetic tabs affixed to an inner side of said hem on said lower edge of said shade body, so that when said shade body is pulled down, said magnetic tabs can stick to the bathtub if made out of magnetic material.

9. A protector shade for a sliding glass door assembly as recited in claim 8, wherein said rear wall, said bottom wall and said side walls of said elongate housing are fabricated out of a durable non-corrosive material.

10. A protector shade for a sliding glass door assembly as recited in claim 9, wherein said elongate L-shaped lid and said hinge are fabricated out of said durable non-corrosive material.

11. A protector shade for a sliding glass door assembly as recited in claim 10, wherein said long flat leg, said short flat leg and said fastener of each said adjustable bracket are fabricated out of said durable non-corrosive material.

12. A protector shade for a sliding glass door assembly as recited in claim 12, wherein said cylindrical roller, said pins and said slat of said elongate shade roller are fabricated out of said durable non-corrosive material.

13. A protector shade for a sliding glass door assembly as recited in claim 11, wherein said durable non-corrosive material is stainless steel.

14. A protector shade for a sliding glass door assembly as recited in claim 13, wherein said shade body is fabricated out of a thin durable flexible waterproof material.

15. A protector shade for a sliding glass door assembly as recited in claim 14, wherein said thin durable flexible waterproof material is plastic.

* * * * *